US008997854B2

(12) United States Patent
Lembcke

(10) Patent No.: US 8,997,854 B2
(45) **Date of Patent: *Apr. 7, 2015**

(54) SWELLABLE PACKER ANCHORS

(75) Inventor: Jeffrey J. Lembcke, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 402 days.

This patent is subject to a terminal disclaimer.

(21) Appl. No.: 12/842,510

(22) Filed: Jul. 23, 2010

(65) Prior Publication Data

US 2012/0018143 A1 Jan. 26, 2012

(51) Int. Cl.
*E21B 33/129* (2006.01)
*E21B 33/12* (2006.01)

(52) U.S. Cl.
CPC ..... *E21B 33/1208* (2013.01); *E21B 33/129* (2013.01); *E21B 33/1216* (2013.01)

(58) Field of Classification Search
USPC ..... 166/134, 118, 387
See application file for complete search history.

(56) References Cited

U.S. PATENT DOCUMENTS

| | | | | |
|---|---|---|---|---|
| 49,544 | A | 8/1865 | Noe | |
| 2,885,009 | A * | 5/1959 | Baker | 277/337 |
| 2,970,651 | A * | 2/1961 | Roberts | 166/212 |
| 3,035,639 | A * | 5/1962 | Brown et al. | 166/150 |
| 3,085,627 | A * | 4/1963 | Sodich | 166/120 |
| 3,097,696 | A * | 7/1963 | Orr | 166/135 |
| 4,375,240 | A * | 3/1983 | Baugh et al. | 166/387 |
| 5,027,894 | A * | 7/1991 | Coone et al. | 166/122 |
| 5,197,542 | A * | 3/1993 | Coone | 166/122 |
| 5,220,959 | A * | 6/1993 | Vance, Sr. | 166/187 |
| 7,387,158 | B2 | 6/2008 | Murray et al. | |
| 7,431,098 | B2 * | 10/2008 | Ohmer et al. | 166/387 |
| 7,597,152 | B2 * | 10/2009 | Wood et al. | 166/387 |
| 7,661,471 | B2 * | 2/2010 | Murray et al. | 166/179 |
| 7,665,537 | B2 | 2/2010 | Patel et al. | |
| 7,806,192 | B2 * | 10/2010 | Foster et al. | 166/387 |
| 7,874,354 | B2 * | 1/2011 | Freyer | 166/134 |
| 7,896,085 | B2 * | 3/2011 | Nutley et al. | 166/380 |
| 7,931,093 | B2 * | 4/2011 | Foster et al. | 166/387 |
| 8,141,626 | B2 | 3/2012 | Freyer | |
| 8,157,019 | B2 * | 4/2012 | King et al. | 166/387 |
| 2003/0226660 | A1 * | 12/2003 | Winslow et al. | 166/118 |
| 2005/0199401 | A1 * | 9/2005 | Patel et al. | 166/387 |

(Continued)

FOREIGN PATENT DOCUMENTS

| | | |
|---|---|---|
| WO | 2005121498 | 12/2005 |
| WO | 2007107773 | 9/2007 |

(Continued)

OTHER PUBLICATIONS

Dictionary definition of "swell", accessed on Sep. 18, 2012 via thefreedictionary.com.*

(Continued)

*Primary Examiner* — Blake Michener
(74) *Attorney, Agent, or Firm* — Wong, Cabello, Lutsch, Rutherford & Brucculeri LLP

(57) ABSTRACT

Anchor areas are provided that are engaged by swelling of a swellable element of a downhole tool. When engaged with an open hole or casing, the anchor areas provide additional holding power for the swellable element. The anchor areas may be formed as separate elements disposed about the swellable element or may be formed into the surface of the swellable element.

14 Claims, 3 Drawing Sheets

(56) References Cited

U.S. PATENT DOCUMENTS

| | | | | |
|---|---|---|---|---|
| 2007/0151724 | A1* | 7/2007 | Ohmer et al. | 166/187 |
| 2007/0261863 | A1* | 11/2007 | MacLeod et al. | 166/387 |
| 2008/0093086 | A1* | 4/2008 | Courville et al. | 166/378 |
| 2009/0139707 | A1* | 6/2009 | Berzin et al. | 166/118 |
| 2009/0159265 | A1 | 6/2009 | Freyer | |
| 2009/0200043 | A1 | 8/2009 | Olinger | |
| 2009/0205843 | A1* | 8/2009 | Gandikota et al. | 166/387 |
| 2009/0272525 | A1* | 11/2009 | Nutley et al. | 166/241.6 |
| 2009/0308592 | A1* | 12/2009 | Mercer et al. | 166/134 |
| 2010/0038074 | A1* | 2/2010 | Patel | 166/187 |
| 2010/0186969 | A1* | 7/2010 | Metcalfe | 166/382 |
| 2010/0276137 | A1* | 11/2010 | Nutley et al. | 166/185 |
| 2012/0073834 | A1* | 3/2012 | Lembcke | 166/387 |

FOREIGN PATENT DOCUMENTS

| | | | | |
|---|---|---|---|---|
| WO | 2008051250 | | 5/2008 | |
| WO | WO 2009/001073 | * | 12/2008 | E21B 43/02 |
| WO | 2009120759 | | 10/2009 | |

OTHER PUBLICATIONS

Dictionary definitions of "inflate" and "volume", accessed Jan. 17, 2013 via thefreedictionary.com.*

Search Report for European Application No. EP11166712 dated Jul. 1, 2013, 3 pages.

* cited by examiner

SWELLABLE PACKER ANCHORS

TECHNICAL FIELD

The present invention relates to the field of downhole apparatus for use in hydrocarbon well, and in particular to downhole apparatus for use with swellable materials, such as are used in the hydrocarbon exploration and production industries, as well as a downhole tool incorporating the apparatus, and a method of use. Embodiments relate to isolation and sealing applications that use swellable wellbore packers.

BACKGROUND ART

In the field of hydrocarbon exploration and production, various tools are used to provide fluid seals between two components in a wellbore. Annular barriers have been designed for preventing undesirable flow of wellbore fluids in the annulus between a wellbore tubular and the inner surface of a surrounding tubular or the borehole wall. In many cases, the annular barriers provide a fluid seal capable of holding a significant pressure differential across its length. In one application, a wellbore packer is formed on the outer surface of a completion string that is run into an outer casing in a first condition having a particular outer diameter. When the packer is in its desired downhole location, it is inflated or expanded into contact with the inner surface of the outer casing to create a seal in the annulus. Similar wellbore packers have been designed for use in openhole environments, to create a seal between a tubular and the surrounding wall of the wellbore.

Conventional packers are actuated by mechanical or hydraulic systems. A force or pressure is applied from the wellhead to move a mechanical packer element radially into contact with the surrounding surface. In an inflatable packer, fluid is delivered from the wellhead to inflate a chamber defined by a bladder around the tubular body.

More recently, wellbore packers have been developed which include a mantle of swellable material formed around the tubular. The swellable material is selected to increase in volume on exposure to at least one predetermined fluid, which may be a hydrocarbon fluid or an aqueous fluid or brine. The swellable packer may be run to a downhole location in its unexpanded state, where it is exposed to a wellbore fluid and caused to increase in volume. The design, dimensions, and swelling characteristics are selected such that the swellable packer element expands to create a fluid seal in the annulus to isolate one wellbore section from another. Swellable packers have several advantages over conventional packers, including passive actuation, simplicity of construction, and robustness in long-term isolation applications.

In addition, swellable packers may be designed for compliant expansion of the swellable mantle into contact with a surrounding surface, such that the force imparted on the surface prevents damage to a rock formation or sandface, while still creating an annular barrier or seal. Swellable packers therefore lend themselves well to openhole completions in loose or weak formations.

The materials selected to form a swellable element in a swellable packer vary depending on the specific application. Swellable materials are elastomeric (i.e. they display mechanical and physical properties of an elastomer or natural rubber). Where the swellable mantle is designed to swell in hydrocarbons, it may comprise a material such as an ethylene propylene diene monomer (EPDM) rubber. Where the swellable mantle is required to swell in aqueous fluids or brines, the material may, for example, comprise an N-vinyl carboxylic acid amide-based cross-linked resin and a water swellable urethane in an ethylene propylene rubber matrix. In addition, swellable elastomeric materials may be designed to increase in volume in both hydrocarbon fluids and aqueous fluids.

Applications of swellable tools are limited by a number of factors, including their capacity for increasing in volume, their ability to create a seal, and their mechanical and physical properties when in their unexpanded and expanded states. A swellable packer may be exposed to high pressure differentials during use. The integrity of the annular seal created by a well packer is paramount, and a tendency of the swellable material to extrude, deform, or flow under forces created by the pressure differential results in a potential failure mode between the apparatus and the surrounding surface. In practice therefore, swellable tools and in particular swellable packers are designed to take account of the limitations of the material. For example, a swellable packer may be run with an outer diameter only slightly smaller than the inner diameter of the surrounding surface, in order to limit the percentage volume increase of the swellable material during expansion. In addition, swellable packers may be formed with packer elements of significant length, greater than those of equivalent mechanical or hydraulic isolation tools, in order to increase the pressure rating and/or reduce the chances of breaching the seal at high differential pressures.

Completions that are subjected to fracturing often experience tubing movement effects due to contracting of the tubing from cooling and from diameter growth or expansion. These forces can move packers, causing them to leak. The industry has desired a way to keep completions from moving. Conventional mechanical packers have slips that bite into the casing. Inflatable packers have metal ribs that bite into the casing or open hole. Open hole completions are often run with stand-alone anchoring devices like the Petrowell ROK-ANKOR®. ("ROK-ANKOR" is a registered trademark of Petrowell, Inc.) Swellable packers rely on the friction between the swellable material and the open hole or casing, which may not always be sufficient to avoid movement of and leakage around the packers.

SUMMARY OF INVENTION

A swellable packer uses one or more anchor areas to anchor the swellable element to the surrounding surface of the open hole or casing. The anchor areas may be formed in various ways, including wickers or roughened areas disposed on the surface of the swellable element. In some embodiments, the anchor areas are formed as part of a support assembly positioned at an end of the swellable element that is expanded by swelling of the swellable element. Other anchor areas may be spaced across the surface of the swellable element in any desired arrangement.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
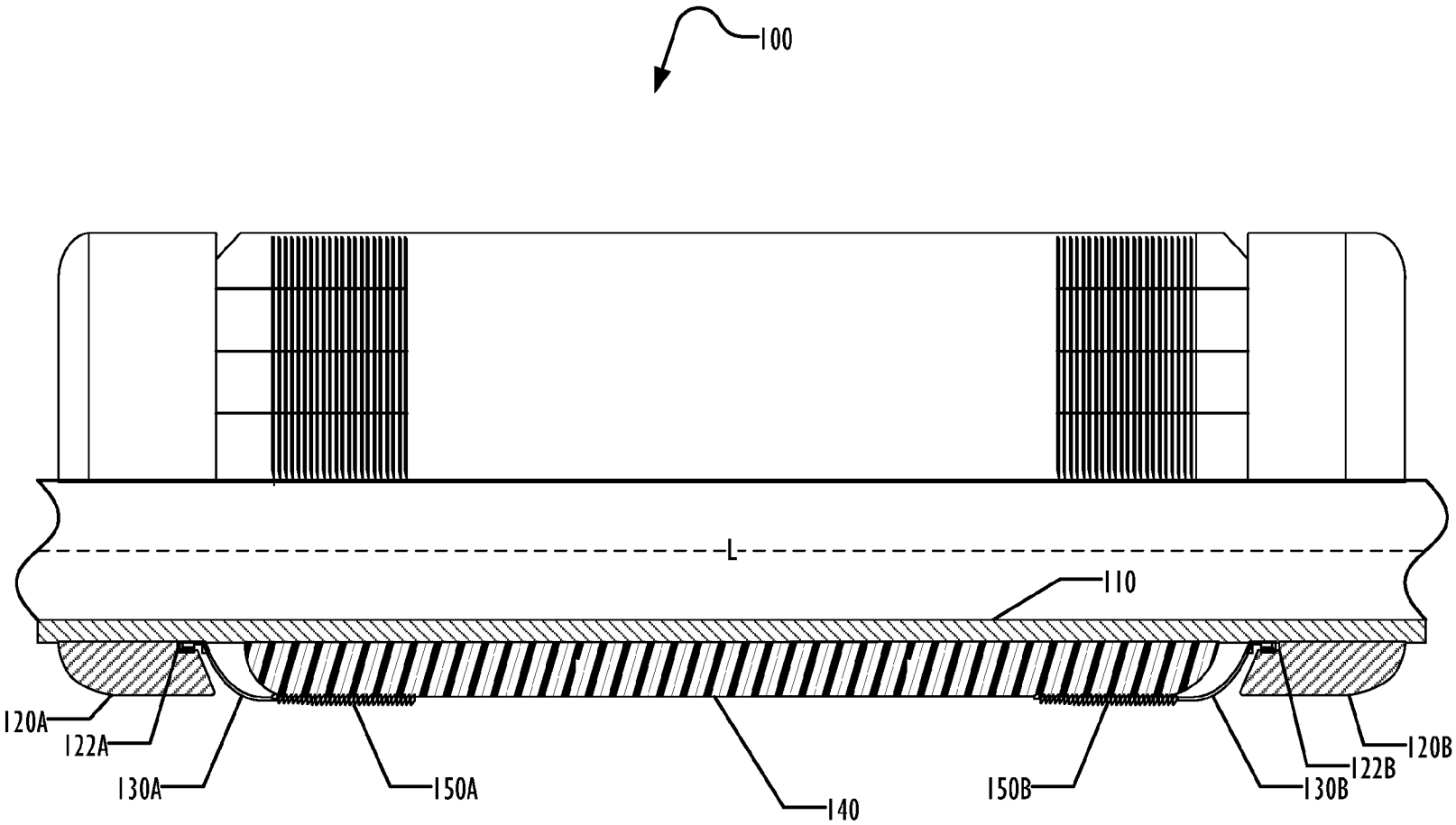
FIG. 1 is a cutaway view of a swellable packer according to one embodiment.

FIG. 1 illustrates a swellable packer 100 according to one embodiment. In this embodiment, a swellable element 140 is disposed about a mandrel 110 along the longitudinal axis L. The swellable element 140 may be bonded to the mandrel 110 using bonding techniques known to the art or may use other techniques for attaching the swellable element 140 to the mandrel 110. Although as described herein the swellable element 140 is disposed about a mandrel, in some embodiments a tubular, such as a base pipe, may be used instead of a mandrel.

In the embodiment illustrated in FIG. 1, end rings 120A and 120B are disposed about the mandrel 110 at each end of the swellable element 140. The end rings 120A/B are secured to the mandrel 110, in one embodiment by screws that extend radially through the end rings 120A/B and into abutment with the mandrel 110. Support assemblies 130A and 130B are disposed about the mandrel 110 between the swellable element 140 and the end rings 120A/B at opposing ends of the packer 100. In some embodiments, an additional elastomeric element (not shown for clarity) may be positioned between the support assemblies 130A/B and the swellable element 140.

In one embodiment, each support assembly 130 (shown most clearly in FIG. 3) comprises a support ring 300 defining a throughbore sized to accommodate the mandrel 110. The support ring 300 is formed from a metal such as stainless steel, and comprises a neck portion 310 and a flared portion 320. The neck portion 310 is received in a corresponding recess 122A/B in the end rings 120A/B, and abuts the end wall of the recess. The support assemblies 130A/B may be anchored to the mandrel 110 at attachment points 312 in the neck portion 310, using any anchoring technique known to the art, including screws.

The flared portion 320 extends radially and longitudinally on the mandrel 110 to define an internal volume when assembled, and the which accommodates a part of the swellable element 140 as illustrated in FIG. 1. The support ring 300 comprises a concave inner surface that defines a cup, and the outer surface may be angled to define a conical part 330 and a cylindrical part 332.

The support ring 300 may be provided with circumferentially spaced slots 340 that extend from an outer edge 350 (distal the mandrel 110), through the flared portion 320 to a predetermined depth, to define leaves 360 in the flared portion 320. The slots 350 facilitate deployment of the support assembly 130, allowing opening of the slots 350 by pivoting or deformation of the leaves 360. The slots 350 may for example be formed by water jet cutting or wire cutting. In alternative embodiments, instead of slots forming leaves 360 that separate when expanded by expansion of the swellable element 140, the flared portion 320 may be formed of a material that expands by stretching.

An anchor area 370 is formed from the outer edge 350 on a portion of the flared portion 320 to a predetermined depth. In one embodiment, illustrated in FIG. 3, the anchor area 370 comprises a plurality of wickers 375 formed into or onto the radially outward surface of the anchor area 370. The wickers 375 may be formed of stainless steel or any other material of sufficient hardness to perform the desired anchoring function. The material is selected to be harder than the surrounding surface. The wickers 375 are generally shaped so that when engaged with the surrounding surface of the open hole or casing, they anchor the swellable element 140 to the surrounding surface, resisting movement. In one embodiment, the anchor area 370 of support assembly 130A may have wickers 375 that resist movement in one direction along axis L, while the anchor area 370 of support assembly 130B may have wickers that resist movement in the other direction. In other embodiments, the anchor area 370 of both support assemblies 130A/B may have wickers that resist movement in both axial directions.

In other embodiments, the anchor area 370 may use other techniques to provide a anchoring area, such as a roughened surface, embedded pieces of material that extend outwardly from the anchor area, etc. These techniques are illustrative and by way of example only, and any technique known to the art for forming an area to anchor against an opposed surface known to the art may be used in the anchor areas 370.

The swellable element 140 is formed from a swellable elastomeric material selected to increase in volume on exposure to a predetermined triggering fluid. Such materials are known in the art. In one embodiment, the swellable elastomeric material is an ethylene propylene diene monomer (EPDM) rubber selected to swell in hydrocarbon fluids, but alternative embodiments may comprise materials which swell in aqueous fluids, or which swell in both hydrocarbon and aqueous fluids. In FIG. 1, the apparatus is shown in a run-in configuration. The swellable element 140 is in an unswollen condition, and its outer diameter (OD) is approximately flush with the OD of the end rings 120A/B.

In the wellbore, the swellable packer 100 is exposed to the triggering fluid, which may be a fluid naturally present in the well, or may be a fluid injected or circulated in the well. The fluid diffuses into the swellable element 140, causing it to increase in volume.

The support assemblies 130A/B are flexible and shaped to conform to the ends of the swellable element 140. As the swellable element 140 swells in the presence of the triggering fluid, the swellable element 140 expands radially outwardly to seal with the surrounding surface of the open hole or casing (not shown), but also expands axially into the support assemblies 130A/B. The increase in volume exerts an outward radial force on the support assemblies 130A/B, deforming the support assemblies 130A/B radially outwardly as urged by the swellable element 140. The slots 340 open to deploy the support assembly 130A/B. The leaves 360 separate as the deformation continues, and the outer edge 350 and wicker section 370 spread out around the expanded swellable element 140. This deformation and the swelling of the swellable element 140 urge the wicker section 370 into the surrounding surface of the open hole or casing. The pressure of the swellable element 140 keeps the wicker section 370 engaged with the surrounding open hold or casing, and the engaged wicker section provides additional resistive force, anchoring and preventing movement of the swellable packer 100.

The rings 130A/B additionally may serve as an anti-extrusion barrier, retaining the longitudinal end of the swellable element 140 as it swells and expands after insertion downhole in the presence of the triggering fluid.

The support assemblies 130A/B function to mitigate the effects of forces on the swellable material that may otherwise adversely affect the seal. The support assemblies 130A/B are operable to expand to the full extent of the wellbore cross section, and contain and support the expanded swellable element 140 over the whole wellbore. The support assemblies 130A/B may also provide an extrusion barrier, mitigating or eliminating extrusion of the swellable material which may otherwise be caused by shear forces in the swellable material due to pressure differentials across the seal and axial forces on the mandrel 110.

Axial forces due to pressure differentials or weight on the mandrel tend to be redirected through the support assembly 130 into the anchor areas 370, thus increasing the holding ability of the anchor areas 370. The concave shape of the support assemblies 130A/B helps capture longitudinal forces in the elastomer of the swellable element 140 and utilizes them to enhance the seal and the anchoring of the anchoring areas 370. The anchor areas 370 may also be deformed compliantly against the surrounding surface in an open hole deployment, conforming to the open hole surface, and provides both containment of the volume of the swellable element 140 as well as increases holding and sealing ability.

Figure 2:
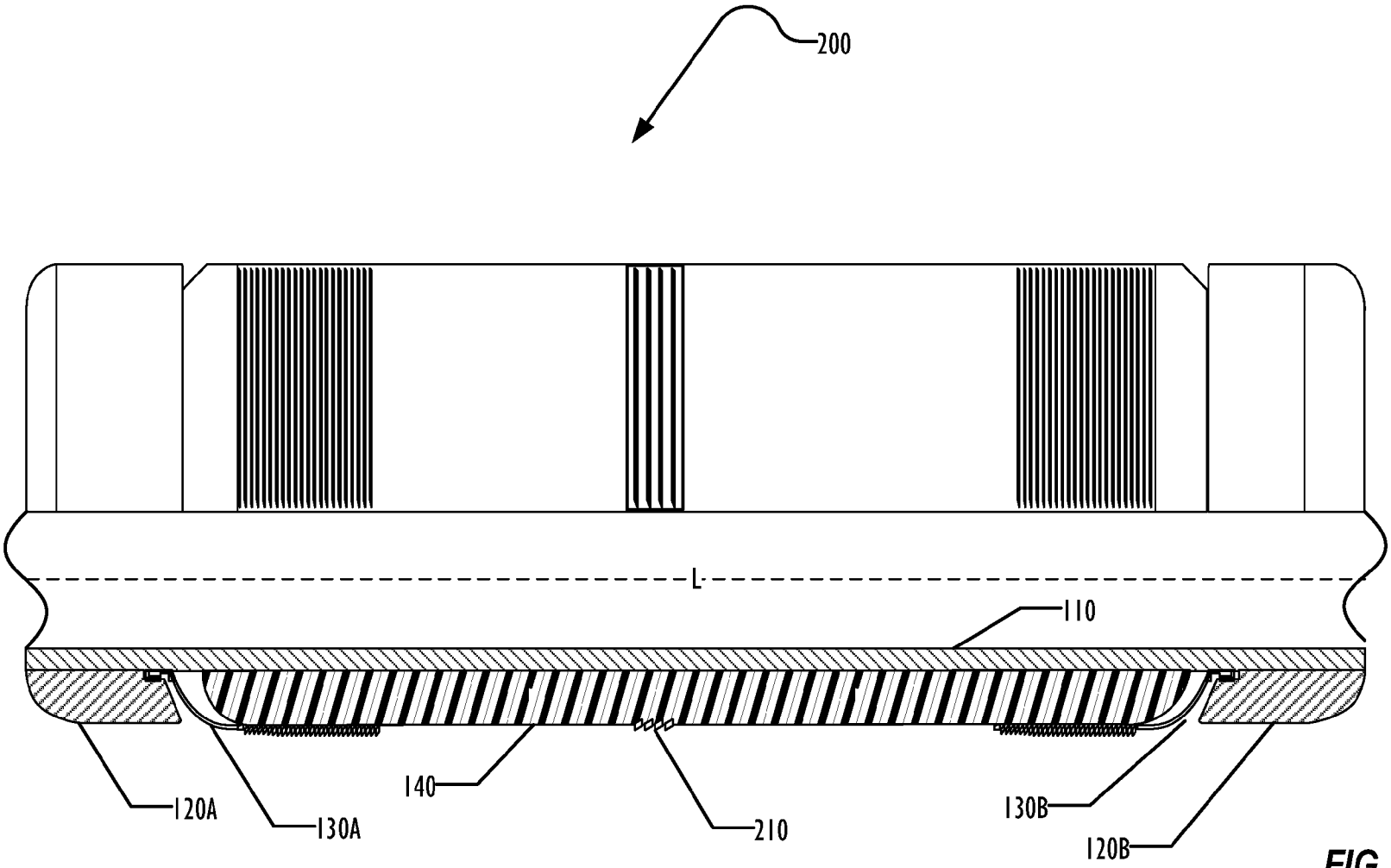
FIG. 2 is a cutaway view of a swellable packer according to another embodiment.

FIG. 2 is a cutaway view of a swellable packer 200 according to another embodiment. In addition to the features described above, one or more body anchor areas 210 may be formed about the swellable element 140 distal to the ends of the swellable element 140. Although only a single body anchor area 210 is illustrated in FIG. 2 for clarity, any number of body anchor areas 210 may be provided. The body anchor area 210 may be formed in the same way as the anchor area 370 of the support assembly or may use different construction techniques or materials.

The materials used to form the components of the support assembly 130 may be varied according to the required application and performance. For example, the assembly 130 may include components formed from materials selected from steels, plastics, epoxy resins, elastomers or natural rubbers of varying hardness, aluminum alloys, tin plate, coppers, brass, other metals, KEVLAR® or other composites, carbon fiber and others (KEVLAR® is a registered trademark of E. I. du Pont de Nemours and Company.). Any of a number of suitable manufacturing techniques may be used, including press forming and machining.

Although as shown in FIG. 1, two support assemblies 130A/B are illustrated, embodiments can be deployed with only a single support assembly 130 on a desired end of the swellable element 140.

In one embodiment, illustrated in FIG. 2, the body anchor areas 210 are formed as a ring with wickers formed of a material such as stainless steel, although other materials may be used that are of sufficient hardness to engage with the surrounding surface of the open hole or casing, typically being material selected to be harder than the surrounding surface. The body anchor areas 210 may be disposed about the swellable element 140 in such a way that radial swelling of the swellable element 140 urges the body anchor area against the surrounding surface of the open hole or casing, anchoring the swellable element 140 and increasing the holding ability of the swellable packer 200. The body anchor areas 210 in one embodiment may be formed from a material that expands with the radial expansion of the swellable element 140. In another embodiment, the body anchor areas 210 may be manufactured to break into section similar to the expansion of the leaves 360 of the support assemblies 130A/B described above. In either type of embodiment, the body anchor areas provide a similar gripping force when urged into the surrounding surface of the open hole or casing by the expansion of the swellable element 140, anchoring the swellable element 140 and resisting movement of the swellable packer 100.

In other embodiments, the body anchor areas 210 may be formed as part of the swellable element 140 itself, such as by roughening an area of the outer surface of the swellable element 140, so that when engaged with the surrounding surface, the rough and area anchors the swellable element 140 and resists movement of the swellable packer 100.

In one embodiment, the body anchor areas 210 may be provided instead of using the anchor area 370 of support assemblies 130A/B, and may include placement of the body anchor areas 210 at one or both ends of the swellable element 140, in addition to, or instead of placement as illustrated in FIG. 2. In such an embodiment, the anti-extrusion functionality of the support assemblies 130A/B may be provided by end rings 120A/B or the support assemblies 130A/B may omit the anchor area 370, but provide the anti-extrusion functionality.

Although described above as rings, embodiments may use ribs or other separate elements instead of rings, replacing rings 130A/B or body anchor areas 210.

The body anchor areas 210 as described above are formed external to and as separate elements from the swellable element 140. In some embodiments, the body anchor areas 210 may be formed internal to the swellable element 140. In such an embodiment, the body anchor areas 210 may be formed close to the radial outward surface of the swellable element 140 so that expansion of the swellable element 140 causes a pinching of the material of the swellable element 140 between the internally formed body anchor areas 210 and the surface of the open hole or casing.

Any desired patterns or formations of elements may be used as part of the body anchor areas 210 or the gripper rings 130A/B to provide an anchoring surface appropriate to the application for which the swellable packer 100 or 200 is to be employed. In some embodiments, the end rings 120A/B may be omitted.

Figure 3:
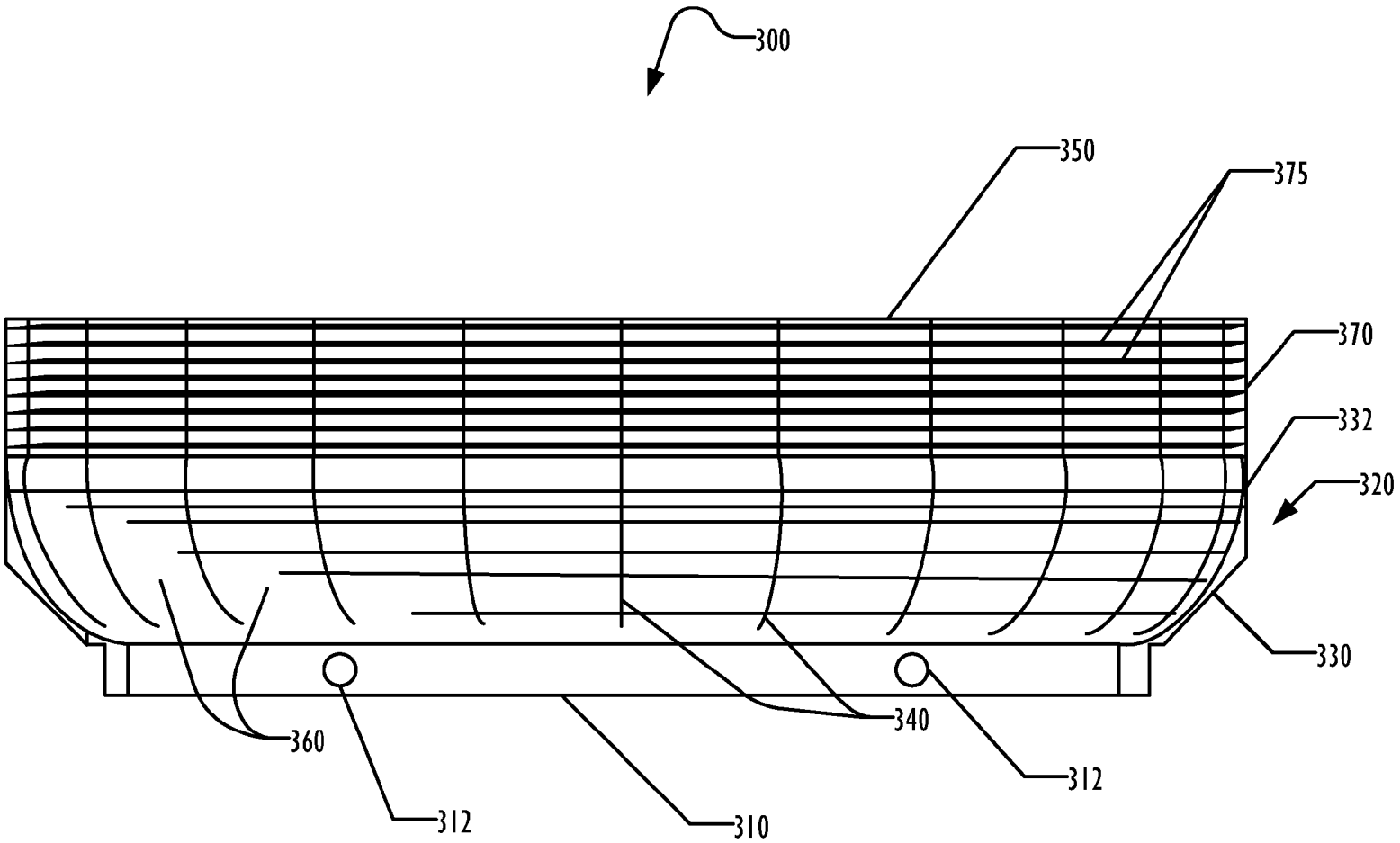
FIG. 3 is a side view of a support assembly for a swellable packer according to one embodiment.

Although the embodiments illustrated in FIGS. 1-3 illustrate anchoring areas that are formed circumferentially to the swellable element, other embodiments may provide anchoring areas that extend longitudinally as ribs along some or all of the swellable element 140. A plurality of these longitudinal anchoring areas may be spaced circumferentially about the swellable element 140 as desired.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A downhole apparatus, comprising:

a mandrel;

a swellable element comprising a swellable elastomeric material selected to increase in volume on absorption of at least one predetermined fluid, secured to the mandrel;

a pair of end rings, screwed to the mandrel, disposed at each end of the swellable element;

a pair of flexible support assemblies, rigidly screwed to the mandrel, each disposed between one of the end rings and the corresponding end of the swellable element, defining an unfilled internal volume operable to receive a portion of the swellable element upon axial expansion of the swellable element, each comprising:

a first anchor area, formed on a radially outer surface of a portion of the support assembly, operable to anchor the swellable element to a surrounding surface upon swelling of the swellable element, comprising:

a plurality of wickers, formed of material selected to be harder than the surrounding surface.

2. The downhole apparatus of claim 1, wherein the first anchor area further comprises:

a roughened radially outward surface of a portion of the swellable element.

3. The downhole apparatus of claim 1, wherein each support assembly comprises:

a neck portion screwed to the mandrel; and a flared portion, connected to the neck portion, wherein the flared portion is configured to receive and expand about the end of the swellable element upon expansion of the swellable element, wherein the first anchor area is formed as a radially outward surface of the flared portion.

4. The downhole apparatus of claim 3, wherein the first anchor area further comprises:

a roughened radially outer surface of the support assembly.

5. The downhole apparatus of claim 3, wherein each support assembly forms an axial extrusion barrier for the swellable element.

6. The downhole apparatus of claim 1, further comprising:

a second anchor area, disposed on a radial surface of a portion of the swellable element, operable to resist movement relative to the surrounding surface upon expansion of the swellable element.

7. The downhole apparatus of claim 6, wherein the second anchor area comprises an area of wickers formed as a ring disposed about a portion of the swellable element.

8. The downhole apparatus of claim 6, wherein the second anchor area is disposed about the swellable element distal to the first anchor area.

9. A downhole apparatus, comprising:

a mandrel;

a swellable element, secured to the mandrel, comprising a swellable elastomeric material selected to increase in volume on absorption of at least one predetermined fluid; and a pair of flexible support assemblies, rigidly screwed to the mandrel, each disposed about an end portion of the swellable element, defining an unfilled internal volume operable to receive a portion of the swellable element upon axial expansion of the swellable element, comprising:

a flared portion, operable to be deployed from a retracted position, and configured to receive and expand about the end of the swellable element upon axial expansion of the swellable element; and a first anchor area, disposed with a surface of the flared portion, and operable to anchor the swellable element to a surrounding surface upon expansion of the swellable element, a pair of end rings screwed to the mandrel, wherein each support assembly is disposed longitudinally between the swellable element and one of the pair of end rings.

10. The downhole apparatus of claim 9, wherein the first anchor area comprises:

a plurality of wickers, formed of material selected to be harder than the surrounding surface.

11. The downhole apparatus of claim 9, wherein the support assembly forms an axial extrusion barrier for the swellable element.

12. The downhole apparatus of claim 9, further comprising:

a second anchor area, disposed about a surface of the swellable element, operable to anchor the swellable element to the surrounding surface upon expansion of the swellable element.

13. The downhole apparatus of claim 12, wherein the second anchor area comprises:

a plurality of wickers, formed of material selected to be harder than the surrounding surface.

14. The downhole apparatus of claim 9, further comprising:

a plurality of anchor areas, spaced across a surface of the swellable element, and operable to anchor the swellable element to the surrounding surface upon expansion of the swellable element.

* * * * *